United States Patent [19]

Cooper et al.

[11] 4,393,940

[45] Jul. 19, 1983

[54] RETRIEVABLE FLOAT VALVE ASSEMBLY

[75] Inventors: Larry V. Cooper, Lake Charles; Michael W. Sloane, Sr., Egan, both of La.

[73] Assignee: Ace Fishing & Rental Tools, Inc., Lake Charles, La.

[21] Appl. No.: 201,580

[22] Filed: Oct. 28, 1980

[51] Int. Cl.[3] ..... E21B 34/08

[52] U.S. Cl. ..... 166/325; 175/318; 137/430

[58] Field of Search ..... 175/318; 166/325–328, 166/316; 137/430, 433

[56] References Cited

U.S. PATENT DOCUMENTS

| | | | |
|---|---|---|---|
| 672,097 | 4/1901 | Eastman | 175/318 X |
| 2,300,854 | 11/1942 | Allen et al. | 166/325 X |
| 2,767,551 | 10/1956 | Clute | 137/433 |
| 2,858,838 | 11/1958 | Scaramucci | 166/325 X |
| 2,870,784 | 1/1959 | Walls | 166/325 X |
| 3,802,521 | 4/1974 | Oliver | 175/318 |

*Primary Examiner*—Ernest R. Purser
*Attorney, Agent, or Firm*—Charles C. Garvey

[57] ABSTRACT

A retrievable float valve hanger tool assembly provides a hanger sub having a first upper connection for attaching the hanger sub, for example, threadably, to a drill string or work string. A second lower connection means on the sub provides both external and internal threaded (for example) connections, which allow the sub to be connected on its inner threads to a float valve canister and at its external threads to an extension which forms a protective housing about the float valve and its valve canister during operation. The device places the float valve below the joint of the sub and the extension so that an explosive charge can be detonated at the joint allowing easy removal of the float valve from the drill string in the event that the drill pipe becomes stuck. A continuous bore through the assembly allows fluid circulation through the tool in the work string and also allows the explosive charge to be lowered by wireline, for example, to the tool assembly at the appropriate joint. The explosive charge, detonated above the float valve aids in breaking the connection between the hanger sub and extension so that the float valve canister can be removed when the hanger sub and extension are disconnected.

10 Claims, 4 Drawing Figures

RETRIEVABLE FLOAT VALVE ASSEMBLY

BACKGROUND OF THE INVENTION

1. Field of the Invention

The present invention relates to oil and gas well drilling and oil and gas well drilling equipment.

The present invention more particularly relates to a sub assembly for carrying a float valve therewithin which allows easy removal of the float valve from the drill string in the event that the lower portion of the drill string becomes stuck during drilling operation.

2. General Background

In the drilling of oil or gas wells, there are many problems which arise due to formation conditions which might warrant the placement of a float valve into the drill string.

One of these conditions might be, for example, a well coming in and a blowout condition which might develop into a catastrophe.

In these cases where a blowout is feared, or a well "coming in," a float valve can be placed in the drill string which float valve helps eliminate problems of a blowout in certain conditions, acting as an inside "BOP" or inside blow out preventor.

Problems exist in the placement of a float valve in the drill string. This is because if the drill string happens to become stuck, it will be thereafter difficult or impossible to remove the float valve from the drill string. Then, normal operations (such as explosives or wire lines) to remove the drill pipe once stuck cannot be used because of the presence of the float valve blocking the drill pipe bore.

It is to this problem that the present invention is directed.

3. General Discussion of the Present Invention

The present invention provides an assembly for carrying a float valve in a drill string which assembly allows easy removal of the float valve from the drill string should the drill string become stuck.

The present invention provides a hanger sub having a first upper connection means for attaching the hanger sub to the drill string or work string. A lower connection portion of the sub provides inner and outer threads, for example, which allow a float valve canister to be mounted (on the inner threads) as well as an outer protective sub to be mounted (on the outer threads) of the hanger sub.

The valve canister contains therewithin a float valve and the float valve is protectively housed therewithin. During operation a charge can be lowered into the drill string and detonated allowing easy detachment of the float valve from the drill string since it is attached to the sub hanger and is easily removable from the hole therewith.

It is thus an object of the present invention to provide an apparatus which allows easy removal of a float valve from the drill string as in the case of the drill string being at least partially stuck in the hole.

It is another object of the present invention to provide a float valve canister assembly which is easy to construct, easy to use, and easy to maintain.

Another object of the present invention is to provide a hanger sub assembly which can be easily constructed at minimum cost.

Still another object of the present invention is to provide a safety tool for use in the drill string which can be used in even possibly hazardous situations since removal of the tool from the drill string is easily achieved.

Another object of the present invention is to provide a method and apparatus for removing stuck drill pipe which contains a float valve therewithin at least partially blocking the drill string bore.

Still another object of the present invention is to provide a method and apparatus for removing stuck drill pipe with a conventional prima cord and wire line, even when a float valve is being used in the drill string.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
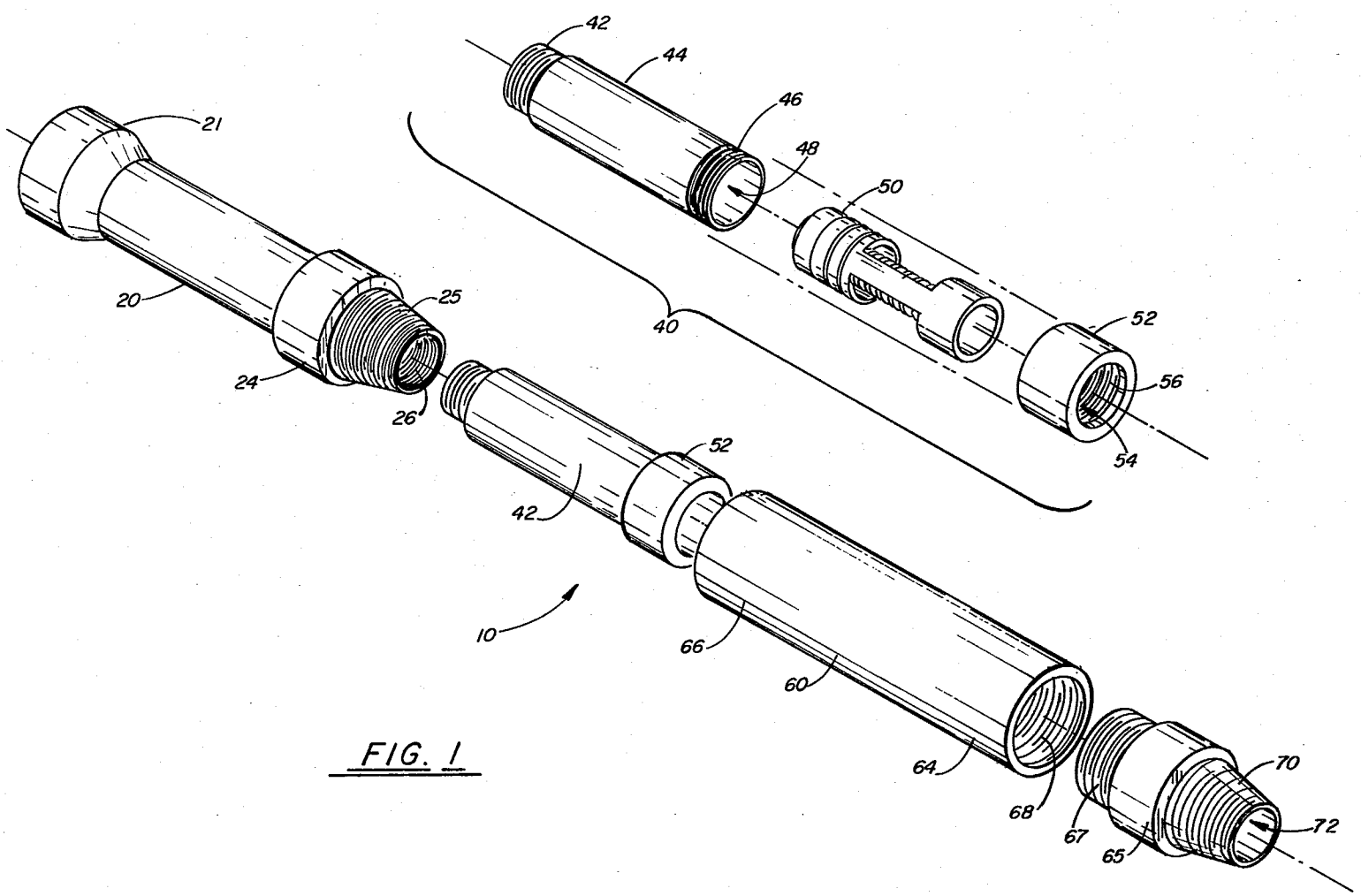
FIG. 1 is a perspective exploded view of the preferred embodiment of the apparatus of the present invention.
Figure 2:
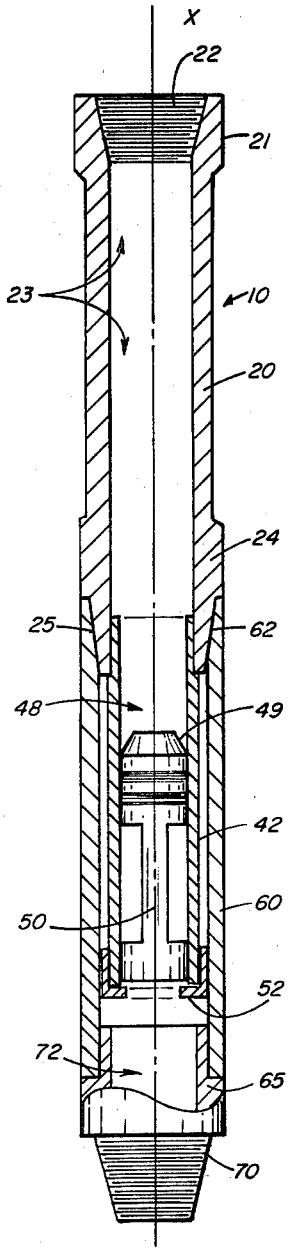
FIG. 2 is a sectional view of the preferred embodiment of the apparatus of the present invention, as assembled.

FIGS. 1 and 2 best show the preferred embodiment of the retrievable float assembly apparatus of the present invention designated generally by the numeral 10. In FIG. 1, assembly 10 provides an uppermost sub hanger 20, connected during operation to both float valve assembly 40, (at float valve canister 42) and to extension 60.

Sub hanger 20 provides an upper 21 end portion and a lower 24 end portion, each of which provides, for example, threaded connections allowing end portions 21, 24 to be attached as will be described more fully hereinafter to the drill string and to a provided float valve assembly 40.

Uppermost portion 21 of sub hanger 20 provides an upper connection 22 which can be a box thread as is known in the drill pipe art. This connection 22 allows sub hanger 20 to be attached to a drill string or work string (not shown), by attaching to the "pin" or male threaded connection of the lowermost joint of pipe.

Sub hanger 20 also provides a central bore 23 which is preferably uniform and cylindrical in shape.

The lowermost 24 end portion of sub hanger 20 provides both external 25 and internal 26 threads.

External threads 25 can be, for example, a pin type external threaded connection as is known in the drill pipe art while inner threaded connection 26 can be any suitable thread which will mate with the external threads 44 of float valve canister 42. It should be understood, that the threads 44 of valve canister 42 are male threads which will threadably engage the inner bore 23 of sub hanger 20 at female threads 26 thereof and be attached thereto during operation. As will be described more fully hereinafter, when connection 25 is broken and sub hanger 20 threadably removed from extension 60, and withdrawn from the well bore, the float valve canister 42 will depart therewith as part of sub hanger 20 safely removing float valve 50 and float valve canister 42 from the well bore.

Float valve assembly 40 as best seen in FIG. 1 comprises a float valve canister 42 having threaded end portions 44, 46 and an inner cylindrical uniform bore 48. During operation, float valve 50 will be inserted into bore 48 with a reduction of thickness of canister bore 48 being provided at its central portion thereof to provide a stop for stopping the upward movement of float valve 50 beyond a desired point once float valve 50 is fully housed within canister 42. The interior bore 48 at the center thereof would thus be a smaller internal diameter (I.D.) than the outer diameter (O.D.) of float valve 50. The narrowed portion of bore 23 is schematically shown as 49 in FIG. 2.

A retainer cap 52 being open at each end and having an inner bore 54 (to allow for circulation of fluids therethrough) is threaded with female threads 56. Retainer 52 would be threadably attached to canister 42 at the provided external threads 46, yet would still allow circulation as desirable through bore 54. Retainer 52 would keep float valve 50 within canister 42 during operation. External threads 44 of canister 42 as aforementioned would threadably attach canister 42 to sub hanger 20 at internal threads 26, this connection being seen more particularly in FIG. 2.

Once canister 42 were threaded to sub hanger 20 at threads 26, extension 60 would be threaded by inner threads 62 at its end portion 66 to external threads 25 of sub hanger 20. In this manner, extension 60 would surround float valve canister 42 as seen in FIG. 2.

Lowermost sub 65 having threads 67 at its upper end portion would attach to extension 60 at internal threads 68 provided on the lowermost portion 64 of extension 60. A suitable pin connection 70 could be provided on sub 65 which sub 65 would also provide an inner cylindrical uniform bore 72.

The entire assembly of retrievable float assembly 10 is seen in FIG. 2 with the central axis thereof shown as XX in FIG. 2. Note that a continuous bore 23 is provided from one end portion of the tool 10 to the other end thereof.

Figure 3:
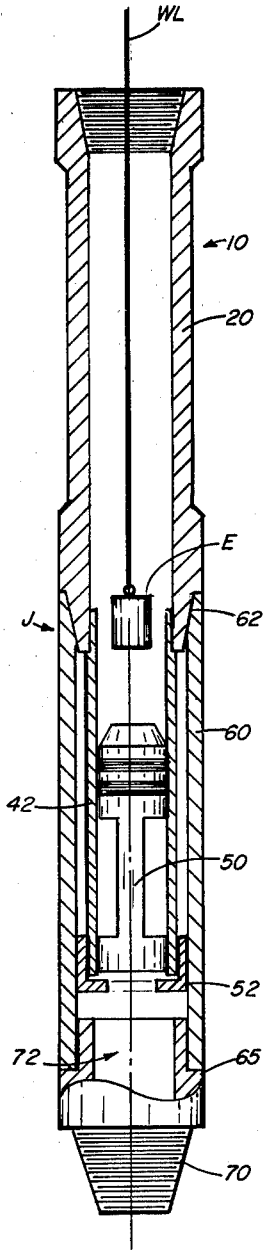
FIG. 3 is a sectional view of the preferred embodiment of the apparatus of the present invention illustrating detonation during disassembly.
Figure 4:
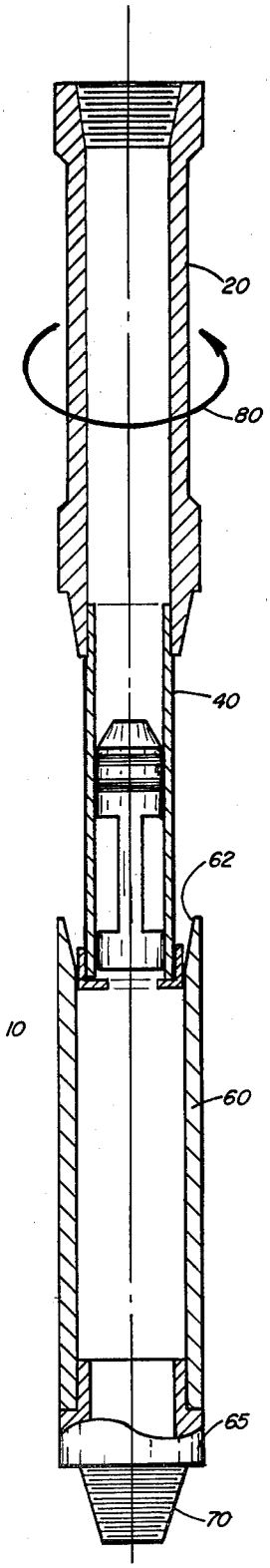
FIG. 4 is a sectional view of the preferred embodiment of the apparatus of the present invention illustrating disassembly after detonation.

In FIGS. 3 and 4, disassembly of sub hanger 20 from extension 60 and the underlying drill string is seen. It should be understood that the continuous drill string below extension 60 would be connected during operation to sub 65 at threads 70.

In FIG. 3 there can be seen a wire line WL having attached at the end portion thereof an explosive device designated generally by the letter E. Explosive device E could be, for example, a prima cord or the like which can be detonated by operation from the surface. Note that explosive device E is placed adjacent joint J which is formed by the connection of hanger sub 20 and extension 60. This connection J is relieved somewhat when explosive device E detonates. Thereafter, a spinning of the drill string above connection J will effect a disassembly of external threads 25 of hanger sub 20 from the internal threads 62 of extension 60. Since canister 40 is attached to upper sub 20, it is removed therewith as upper sub 20 is lifted along with the portion of the drill string which is thereabove, which portion would normally be connected to sub hanger 20 at threads 22.

Arrow 80 schematically illustrates the removal by spinning of sub hanger 20 from extension 60 and that portion of the drill string therebelow which might stick. From the above it can be seen that float valve 50 could be removed from the drill string and once its obstruction was removed from the drill string the wire line WL and another explosive device could be lowered past the point previously occupied by float valve 50 and additional joints of drill pipe removed by a similar procedure of lowering the wire line WL and an explosive device E to a particular joint, detonating the joint, and then removing by unscrewing that particular joint of pipe.

Assembly 10 could be manufactured of structural steel or like material which is known in the art in the construction of drill pipe.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. A retrievable float valve housing tool assembly for placement in a drill string comprising:
   a. a sub member having on one end portion thereof, upper drill string connection means for connecting said sub to a drill string, said sub being open-ended providing between the open ends a continuous fluid conveying bore;
   b. lower drill string connection means on the lowermost portion of said sub for removably connecting said sub at its lower end to a drill string which depends downwardly therefrom;
   c. float valve canister means attachable during operation to and supported by said sub member for housing a float valve therewithin, said canister means having a continuous fluid conveying bore from one end portion to the other thereof and defining therewithin a float valve receptive space; and
   d. attachment means for attaching said canister means to said sub, said means comprising a connector on the canister means which attaches to said sub member at the lower portion thereof independently of the sub member/lower drill string connection, so that disassembly of the sub member/lower drill string connection alone allows removal of the upper portion of the drill string with the sub member and the canister means.

2. The retrievable float housing tool assembly of claim 1, wherein said lower drill string connection means comprises at least in part an extension member having a bore for conveying fluids therethrough and attaching at on end portion to said sub and at the opposite end portion to a portion of the drill string.

3. The retrievable float housing tool assembly of claim 1, wherein said float valve canister means comprises at least in part a canister having an inner space for holding a float valve within said space.

4. The retrievable float housing tool assembly of claim 1, wherein said lower drill string connection means comprises at least in part a pipe extension member having a bore for conveying fluids therethrough and connecting at its upper end portion to said sub, and further comprising a lower connection sub which attaches during operation to said extension.

5. The retrievable float housing tool assembly of claim 1, wherein said float valve canister means comprises:
   a. a canister housing with an inner bore, said housing being threaded at one end portion;

b. a stop within said housing, said stop providing a narrowness to the bore of said canister and defining the limit of upward movement of a float valve placed within said canister; and c. a retainer removably attachable to said canister opposite said stop to disallow removal of a float valve placed within said canister.

6. A retrievable float valve housing tool assembly comprising:

a. an upper sub member having an upper box threaded portion for attachment to a drill string and a lower pin externally threaded connection portion, the sub having a continuous internal bore, the bore providing an internally threaded portion;

b. a float valve canister having a fluid conveying bore and a float valve receptive space for carrying a float valve therewithin, said canister having threaded connector engagable with the internally threaded portion of the sub member to form a connection which positions the float valve receptive space a distance below the sub member pin connection and provides an open section of the bore adjacent the pin connection; and c. a lower drill string member having an upper box connection connectable to said upper sub member at the pin connection portion thereof, said lower drill string member having a bore which allows rotation of both the upper sub and the attached float valve canister during disassembly of the sub member/drill string member pin/box connection.

7. The retrievable float valve housing tool of claim 6 wherein said float valve canister is cylindrical and the bore of said lower drill string member is cylindrical.

8. The retrievable float valve housing tool of claim 7 wherein there is upon assembly of said upper sub member, said float valve canister and said lower drill string member, a space between said canister and said drill string member.

9. The retrievable float valve housing tool of claim 6 wherein said canister is cylindrical and open-ended, having a generally cylindrical inner bore, allowing insertion of a float valve into the canister bore and further comprising a removable retainer for securing a float valve within the canister bore.

10. The retrievable float valve housing tool of claim 9 wherein said canister bore provides an internal stop, defining with the retainer, the position of a float valve within the canister bore.

* * * * *